US011737564B2

(12) United States Patent
Chen

(10) Patent No.: US 11,737,564 B2
(45) Date of Patent: Aug. 29, 2023

(54) FOLDING CHAIR SUPPORT FRAME

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 18/082,743

(22) Filed: Dec. 16, 2022

(65) Prior Publication Data

US 2023/0200539 A1 Jun. 29, 2023

(30) Foreign Application Priority Data

Dec. 27, 2021 (CN) ..... 202123324129.2

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

(56) References Cited

U.S. PATENT DOCUMENTS

2023/0023969 A1* 1/2023 Zhu ..... A47C 4/286

FOREIGN PATENT DOCUMENTS

KR 1590505 B1 * 2/2016 ..... A47C 4/286
KR 101590505 B1 * 2/2016

* cited by examiner

*Primary Examiner* — Anthony D Barfield
(74) *Attorney, Agent, or Firm* — Daniel M. Cohn; Howard M. Cohn

(57) ABSTRACT

A folding chair support frame is provided, including an upper support frame detachably connected to a chair surface, and a lower support frame connected to the upper support frame. The upper support frame includes an upper connection component, and upper connection rods rotatably connected to the upper connection component. The lower support frame includes a lower connection component, and lower connection rods rotatably connected to the lower connection component at a limited angle. The lower connection component is coaxially and rotatably connected to the upper connection component. Free ends of the upper connecting rods and free ends of the lower connecting rods are located on a same side of the lower connection component when the folding chair support frame is in a folded state.

17 Claims, 5 Drawing Sheets

FOLDING CHAIR SUPPORT FRAME

TECHNICAL FIELD

The present disclosure relates to a folding chair support frame.

BACKGROUND

Folding chairs are convenient for storing and carrying, and are widely used in leisure activities, such as outdoor camping or courtyards. Conventional folding chairs each includes a plurality of sets of connection rods that are connected in a hinge manner, so that a lot of space is still needed for storing after the folding chairs are folded. Therefore, there is a need for further improvement.

SUMMARY

The present disclosure aims to solve technical problems that a lot of space is still needed for storing the folding chairs after the folding chairs are folded in the related art, and the folding chairs have poor stability during use.

In order to solve the foregoing technical problems, the present disclosure provides the following technical solutions.

The present disclosure provides a folding chair support frame, including an upper support frame and a lower support frame. The upper support frame is detachably connected to a chair surface, and the lower support frame is connected to the upper support frame. The upper support frame includes an upper connection component and upper connection rods, the upper connection rods are rotatably connected to the upper connection component. The lower support frame includes a lower connection component and lower connection rods, and the lower connection rods are rotatably connected to the lower connection component at a limited angle. The lower connection component is coaxially and rotatably connected to the upper connection component. Free ends of the upper connecting rods and free ends of the lower connecting rods are located on a same side of the lower connection component when the folding chair support frame is in a folded state.

The present disclosure provides a folding chair support frame, including a connection body and connection components, the connection components are connected to the connection body. The connection body includes upper connection positions and lower connection positions. The connection components include upper connection rods and lower connection rods. The upper connection positions are connected to the upper connection rods, and the lower connection positions are connected to the lower connection rods. An interval capable of accommodating at least one of the upper connection rods is defined between any adjacent two of the at least three lower connection positions. The upper connection rods and the lower connection rods are located on a same side of the connection body in a folded state.

The present disclosure provides a folding chair support frame, including a connection body and connection components, the connection components are connected to the connection body. The connection body includes upper connection positions and lower connection positions. The connection components include upper connection rods and lower connection rods. The upper connection positions are connected to the upper connection rods, and the lower connection positions are connected to the lower connection rods. When the folding chair support frame is in an unfolded state, the upper connection rods and the lower connection rods face opposite directions, and are located on an upper side of the connection body and a lower side of the connection body; and when the folding chair support frame is in a folded state, free ends of the upper connection rods and free ends of the lower connection rods are located below the connection body.

In some embodiments, the lower connection rods are rotatably connected to the lower connection component at the limited angle by rotatable connection components.

In some embodiments, the upper connection component is fixedly connected to an upper end of a central shaft, the central shaft passes through the lower connection component, a sleeve is sleeved outside the central shaft, and the sleeve is movable along an axial direction of the central shaft.

In some embodiments, grooves are defined on the sleeve, and convex teeth matching with the grooves are disposed on a head of the rotatable connection component.

In some embodiments, a positioning component is disposed on a lower end of the central shaft, and the positioning component is detachably connected to the sleeve.

In some embodiments, the lower connection component includes a connection body, at least three lower connection positions are disposed on the connection body, and an interval is defined between any adjacent two of the at least three lower connection positions.

In some embodiments, the interval is capable of or substantially capable of accommodating at least one of the upper connection rods.

In some embodiments, the upper connection rods rotate around first connection shafts with respect to the upper connection component, and a vertical distance from a center of each of the first connection shafts to an axis of the upper connection component is greater than or equal to a vertical distance from a lowest point of the interval to the axis.

In some embodiments, a maximum rotation angle of each of the upper connection rods is greater than 90 degrees.

In some embodiments, the upper connection rods are telescopic rods.

Compared with the related art, the present disclosure breaks a common idea that an upper support frame of a folding chair can be only folded at an upper space of the folding chair. According to the present disclosure, the upper connection rods of the folding chair support frame are rotated downward for storage, which greatly reduces the space occupied by the folding chair after being folded. Besides, the lower support frame that allows for pressure distribution to a plurality of points is provided, and the sleeve having a simple and reliable structure cooperates with the lower connection rods to perform synchronous movement, thereby enabling the folding chair to have better stability during use.

DETAILED DESCRIPTION OF THE EMBODIMENTS

Figure 1:
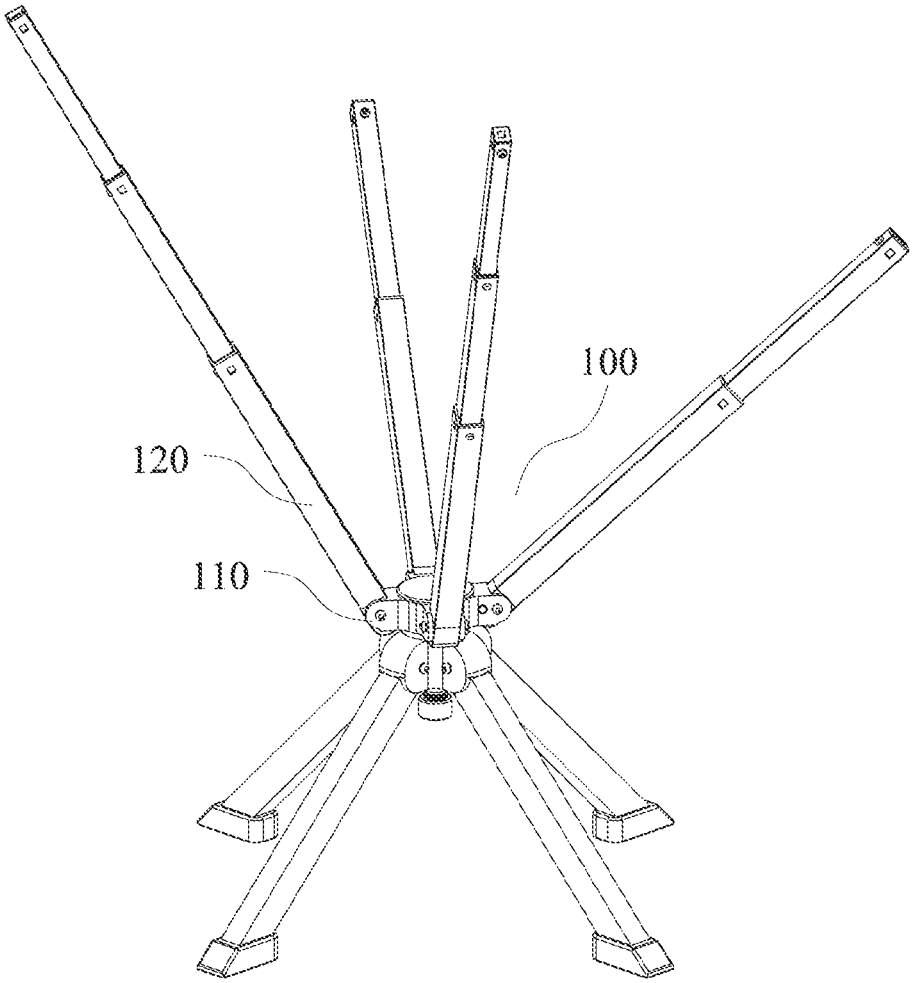
FIG. 1 is a schematic diagram of an overall structure of a folding chair support frame according to the present disclosure.
Figure 2:
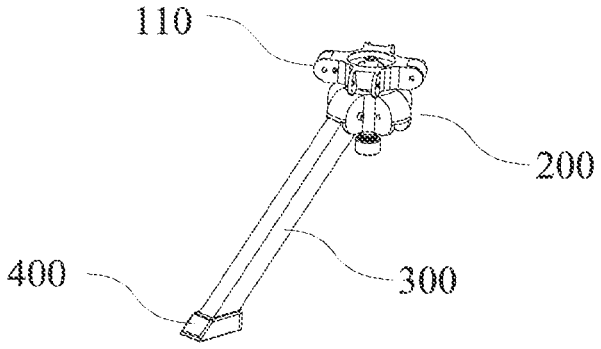
FIG. 2 is a schematic diagram of partial structures of the folding chair support frame according to the present disclosure.

The embodiments of the present disclosure are detailed below with reference to the accompanying drawings.

Unless otherwise specified, the term "axial" used herein means a vertical direction of a main body of a folding chair support frame when in use, the term "radial" used herein means a direction perpendicular to the "axial" direction, and the term "circumferential" used herein means a circumference of a maximum diameter of the main body.

The term "connection component" used herein means an upper connection component and/or a lower connection component, the term "connection position" means an upper connection position and/or a lower connection position, the term "support component" means an upper support component and/or a lower support component, and the term "support rod" means an upper support rod and/or a lower support rod.

The term "folded state" used herein means that the support rods are in a non-use state, in which the support rods neither support a use surface of a corresponding furniture nor are supported by a floor; the term "unfolded state" used herein means that all the support rods are fully unfolded, in which the support rods stably and upwardly support the use surface of the corresponding furniture or are stably and downwardly supported by the floor.

Referring to FIG. 1 to FIG. 5, a folding chair support frame according to the present disclosure is used with a detachable chair surface. The folding chair support frame includes an upper support frame 100 and a lower support frame that are rotatably connected to each other. The upper support frame 100 is detachably connected to the chair surface, and includes an upper connection component 110 and upper connection rods 120 that are rotatably connected to the upper connection component 110. The lower support frame includes a lower connection component 200, lower connection rods 300 that are rotatably connected to the lower connection component 200 at a limited angle, and leg caps 400 disposed at ends of the lower connection rods 300. The limited angle refers to an angle formed when the lower connection rods 300 are rotated from a folded state to a fully unfolded use state. The angle is an acute angle.

The lower connection component 200 is coaxially and rotatably connected to the upper connection component 110. In some embodiments, the upper connection component 110 includes a bearing 203 (which is shown in a simplified manner). The bearing 203 is disposed inside the upper connection component 110. A central shaft 230 passes through the lower connection component 200. An upper end of the central shaft 230 is fixedly connected to the upper connection component 110. By the bearing 203, the upper connection component 110 is rotatably connected to the lower connection component 200 about the central shaft 230. In some embodiments, the upper end of the central shaft 230 is fixedly connected to the upper connection component 110 by a fixing component 201. In some embodiments, the fixing component 201 is a screw. In some embodiments, the bearing 203 is held inside the upper connection component 110 by a limiting washer 202. An outer surface of the bearing 203 abuts against an inner wall of the upper connection component 110, and an inner surface of the bearing 203 abuts against an outer wall of a connection portion 215 of the lower connection component 200.

The central shaft 230 has a limiting portion 231, which fits with a step surface disposed inside the lower connection component 200, and is configured to fix the lower connection component 200 and the bearing 203. A part of an outer side wall of the lower connection component 200 abuts against the inner surface of the bearing 203. In other embodiments, the upper connection component 110 may be in the rotatable connection with the lower connection component 200 by other common rotatable connection manners other than by the bearing.

First connection holes 121 are defined in first ends of the upper connection rods 120, and upper connection positions 111 are disposed on the upper connection component 110. The upper connection rods 120 are rotatably connected to the upper connection positions 111 by first connection shafts 122 disposed in the first connection holes 121. In some embodiments, each first connection hole 121 has a space allowing the corresponding upper connection rod 120 to move with respect to the corresponding first connection shaft 122 along an extension direction of the upper connection rod 120, until the first end of the upper connection rod 120 reaches a first rotation position. At the first rotation position, an end of the upper connection rod 120 can rotate about the first connection shaft 122. However, at a position other than the first rotation position, the upper connection rod 120 cannot rotate with respect to the first connection shaft 122. In some embodiments, the first end of each upper connection rod 120 has a circular-arc transition at its outer edge, which is advantageous for unhindered rotation at the first rotation position.

In some embodiments, a limiting surface 112 is disposed on each upper connection position 111, and a side surface 123 is disposed on each upper connection rod 120. When the folding chair support frame is in a stable state after being unfolded, the side surface 123 is in surface contact with the limiting surface 112, and such contact state is maintained. When there is a need to fold and store the folding chair support frame, first, each upper connection rod 120 moves with respect to the corresponding first connection shaft 122 toward a direction away from the upper connection component 110, until the first end of the upper connection rod 120 reaches the first rotation position; then, the upper connection rod 120 is rotated downward about the first connection shaft 122 until it enters into an interval between two adjacent lower connection positions 211 of the lower connection component 200.

In some embodiments, the upper connection rods 120 are connected to the upper connection positions 111 by reset components 124, which helps to quickly and easily unfold the upper connection rods 120 when unfolding the folding chair support frame. In some embodiments, the reset components 124 are torsion springs or reset springs.

The lower connection component 200 includes a connection body 210. At least three lower connection positions 211 are disposed on the connection body 210. The lower connection positions 211 are in limited rotatable connection with the lower connection rods 300. In some embodiments, each lower connection rod 300 is rotatably connected at a limited angle to the corresponding lower connection position 211 by a rotatable connection component 240. The lower connection positions 211 are evenly arranged around a circumferential direction of the connection body 210. In some embodiments, the interval 214 between any adjacent two of the at least three lower connection positions 211 is capable of or substantially capable of accommodating at least one upper connection rod 120. An accommodating capacity of the interval 214 is a factor determining a size of the storage space occupied by the folding chair. In some embodiments, a quantity of the upper connection positions 111 is equal to a quantity of the lower connection positions 211. In other embodiments, the quantity of the upper connection positions 111 is different from the quantity of the lower connection positions 211.

In some embodiments, when the folding chair support frame is in the folded state, the upper connection rods 120 and the lower connection rods 200 are located on the same side of the connection body 210. When the folding chair support frame is in the unfolded state, the upper connection rods 120 and the lower connection rods 300 are respectively located on upper and lower sides of the connection body 210, and the upper connection rods 120 and the lower connection rods 300 face opposite directions.

The upper connection positions 111 and the lower connection positions 211 are evenly distributed in a staggered manner along the circumferential direction of the connection body 210. The connection components are detachably connected to the connection body 210.

When the folding chair support frame is in the unfolded state, the upper connection rods 120 and the lower connection rods 300 are respectively located on the upper and lower sides of the connection body 210, and the upper connection rods 120 and the lower connection rods 300 face opposite directions. When the folding chair support frame is in the folded state, free ends of the upper connection rods 120 and the lower connection rods 300 are located below the connection body 210. In some embodiments, a vertical distance from a center of each first connection shaft 122 to an axis of the upper connection component 110 is greater than or equal to a vertical distance from a lowest point of each interval 214 to the axis, so that the upper connection rods 120 can be folded at an angle parallel to the lower connection rods 300 or at a smaller angle. For example, when all adjacent leg caps 400 are in contact, all the lower connection rods 300 are folded at a contact position, and tail ends of the upper connection rods 120 in the intervals 214 are approximately folded on an axis of the upper connection component 110 where the contact position is located. The lowest point of the interval 214 refers to a point that is on an outer surface of the interval 214 and has the shortest vertical distance to the axis.

An angle formed when the upper connection rods 120 are rotated from the folded state to the fully unfolded use state is greater than 90 degrees, and may be greater than 180 degrees in an extreme case. In a case that the angle is an obtuse angle, the upper support frame provides better overall stability. The folded state of the upper connection rods 120 is a state in which the upper connection rods 120 enter the intervals 214 and are substantially parallel to the lower connection rods 200 (not shown in the drawings). As shown in FIG. 1, the fully unfolded use state of the upper connection rods 120 is a state in which the chair surface is supported to allow consumers to sit or lie down. In some embodiments, the upper connection rods 120 may be multi-segment telescopic rods. This allows the upper support frame 100 to have different shapes. In addition, when the upper connection rods 120 are retracted to their shortest lengths, the chair surface may be directly folded downward to wrap the folding chair support frame, with no need to be removed from the upper support frame 100, In some embodiments, the chair surface has elasticity or extensibility, thereby helping to improve the storage effect. In other embodiments, the chair surface is made of other flexible material without elasticity or extensibility, and such chair surface may also be folded downward for storage, or may be removed for storage.

Each lower connection position 211 has a space allowing limited rotation of the end of the corresponding rotatable connection component 240 within it. In some embodiments, each lower connection position 211 includes a stop portion 212, which is configured to determine a maximum rotation angle of the rotatable connection component 240 and limit the rotatable connection component 240 to a position of the maximum rotation angle. In some embodiments, an abutment surface 213 is disposed on the stop portion 212. The abutment surface 213 is in surface contact with a part of an outer side wall of the corresponding lower connection rod 300, which is beneficial to uniform pressure distribution. In other embodiments, the abutment surface 213 is in surface contact with a part of an outer side wall of an adapter arm 243 of the rotatable connection component 240, and the outer side wall of the lower connection rod 300 is in no contact or in indirect contact with the abutment surface 213. Whether the outer side wall of the lower connection rod 300 is in direct contact with the abutment surface 213 depends on the connection manner in which the lower connection rod 300 is connected to the rotatable connection component 240 or connected to the adapter arm 243.

In some embodiments, a sleeve 220 is sleeved outside the central shaft 230. The sleeve 220 can move up and down along the axial direction of the central shaft 230, A positioning component 232 is disposed at a lower end of the central shaft 230. The positioning component 232 and the limiting portion 231 together determine a maximum displacement of the sleeve 220 in the axial direction of the central shaft 230. When the sleeve 220 is stably connected to the positioning component 232, the rotatable connection components 240 are opened to a maximum rotation angle. When the rotatable connection components 240 are rotated until the lower support frame is fully folded into its minimum size, the sleeve 220 is away from the positioning component 232, and close to the limiting portion 231 or abuts against the limiting portion 231. In some embodiments, the positioning component 232 is a nut with an internal thread, and an external thread matching with the internal thread is disposed on a lower part of the sleeve 220. In other embodiments, the positioning component 232 may be connected to the lower part of the sleeve 220 by means of a snap-fit connection or other detachable connection, such as by an elastic snap-fit buckle.

In some embodiments, grooves 221 are defined on the sleeve 220. In some embodiments, the grooves are continuously distributed in a circumferential direction of the sleeve 220, to form continuous annular or approximately annular grooves. In some embodiments, an arc surface 222 is formed between side edges of circumferentially adjacent grooves 221, so as to form a circular-arc transition, thereby reducing resistance when the sleeve 220 is mounted or the sleeve 220 is rotated in the connection body 210. Convex teeth 241 matching with the grooves 221 are disposed on a head of each rotatable connection component 240. When the rotatable connection component 240 is rotated about a rotation shaft 242 inside the lower connection position 211, the convex teeth 241 are sequentially snapped into and out of the grooves 221, so as to drive the sleeve 220 to move up and down along the axial direction. In addition, during the relative movement of the convex teeth 241 and the grooves 221, at least one convex tooth 241 remains in the grooves 221.

Figure 3:
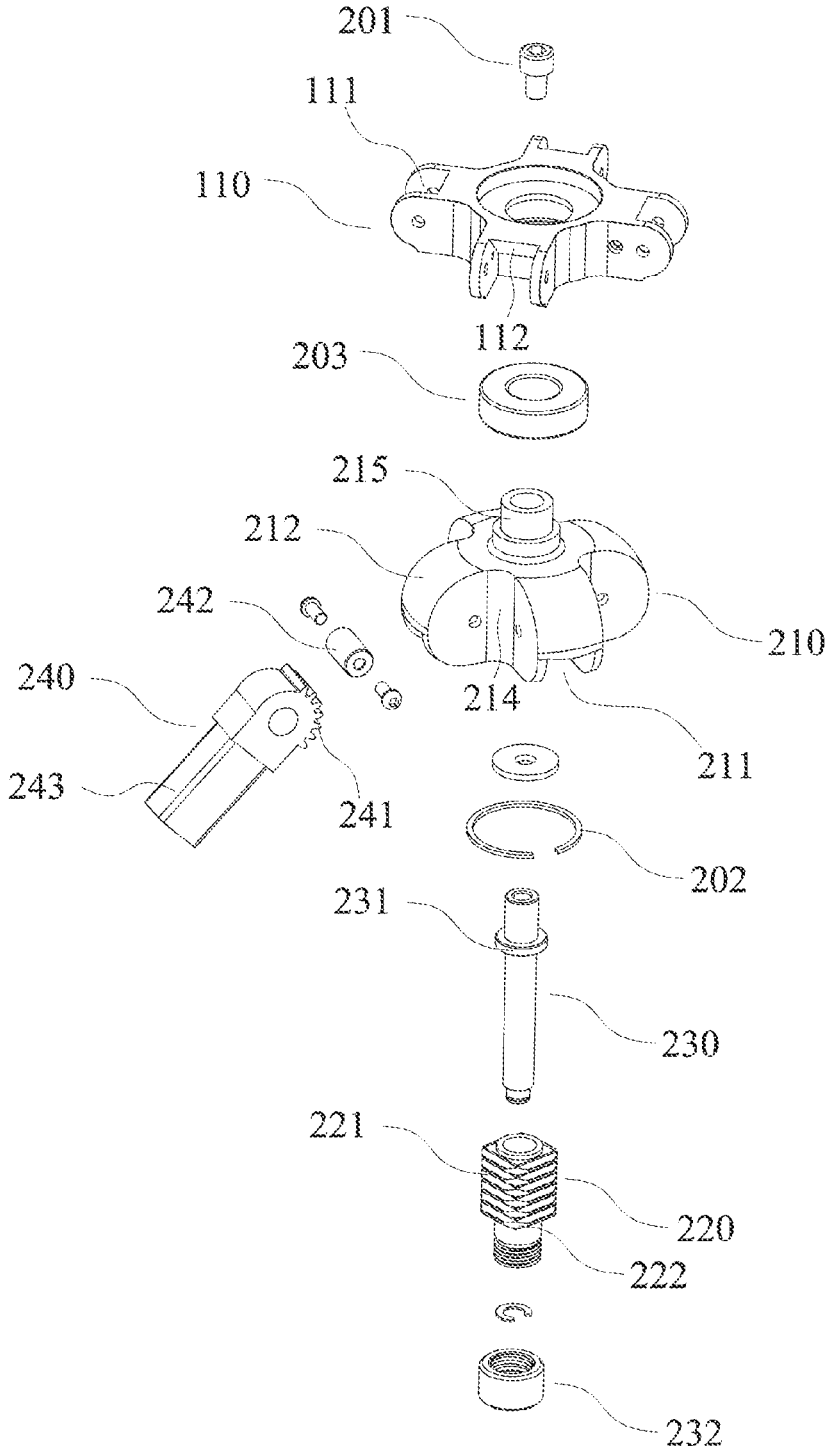
FIG. 3 is an exploded diagram of partial structures of the folding chair support frame according to the present disclosure.
Figure 4:
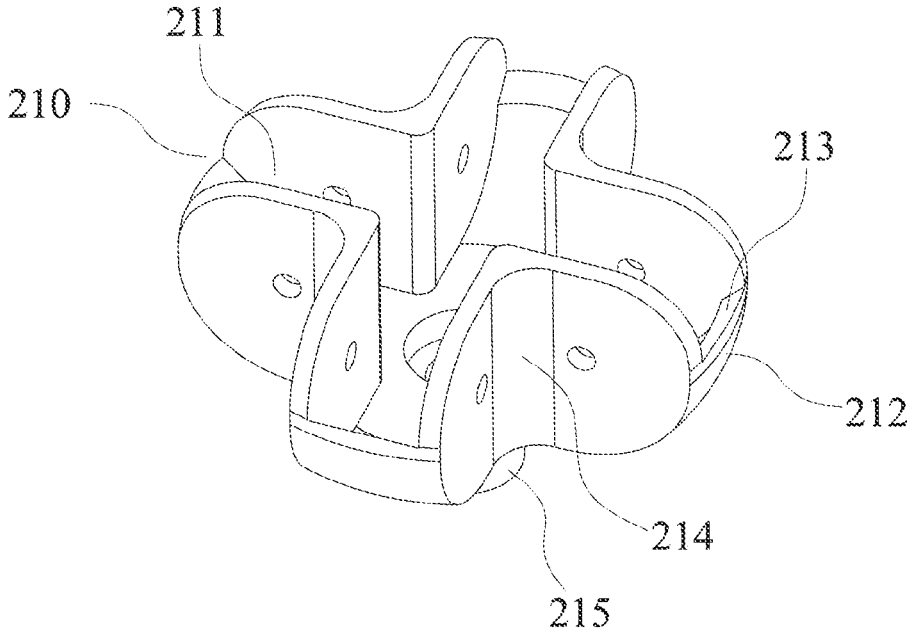
FIG. 4 is a structural schematic structural diagram of a lower support frame of the folding chair support frame according to the present disclosure.
Figure 5:
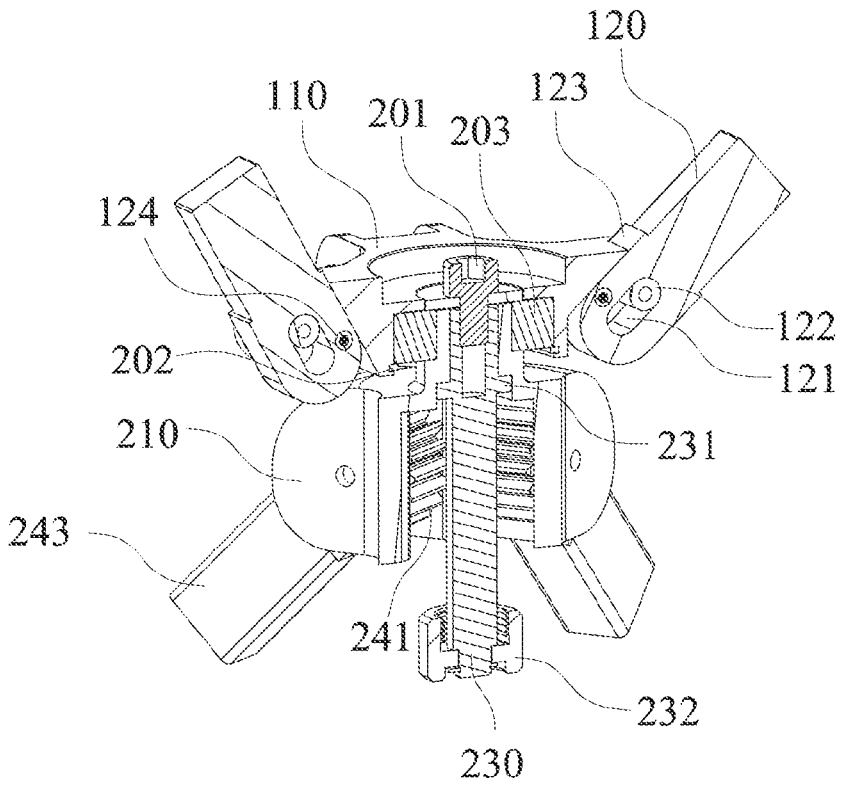
FIG. 5 is a cross-section diagram of partial structures of a folding chair support frame according to the present disclosure (with a sleeve being omitted).

In some embodiments, an outer surface of the sleeve 220 has a regular polygonal cross-section. A quantity of sides of the regular polygon is equal to the quantity of the lower connection portions 211. As shown in FIG. 3, the sleeve 220 has a square cross-section, and correspondingly there are four lower connection positions 211. In other embodiments, the sleeve 220 may have a regular triangle cross-section or a regular pentagon cross-section.

The cooperation of the sleeve 220 and the rotatable connection component 240 allows the plurality of lower connection rods to perform synchronous rotation, and also enhances the overall stability of the lower support frame when in use.

What is claimed is:

1. A folding chair support frame, comprising:

an upper support frame; and, detachably connected to a chair surface; and a lower support frame; connected to the upper support frame;

wherein the upper support frame is detachably connected to a chair surface, and the lower support frame is connected the upper support frame; the upper support frame comprises an upper connection component and upper connection rods, the upper connection rods are rotatably connected to the upper connection component; the lower support frame comprises a lower connection component and lower connection rods, the lower connection rods are rotatably connected to the lower connection component at a limited angle; the lower connection component is coaxially and rotatably connected to the upper connection component; and free ends of the upper connecting rods and free ends of the lower connecting rods are located on a same side of the lower connection component when the folding chair support frame is in a folded state;

wherein the lower connection rods are rotatably connected to the lower connection component at the limited angle by rotatable connection components;

wherein the upper connection component is fixedly connected to an upper end of a central shaft, the central shaft passes through the lower connection component, a sleeve is sleeved outside the central shaft, and the sleeve is movable along an axial direction of the central shaft;

wherein grooves are defined on the sleeve, and convex teeth matching with the grooves are disposed on a head of the rotatable connection component.

2. The folding chair support frame according to claim 1, wherein a positioning component is disposed on a lower end of the central shaft, and the positioning component is detachably connected to the sleeve.

3. The folding chair support frame according to claim 1, wherein the lower connection component comprises a connection body, at least three lower connection positions are disposed on the connection body, and an interval is defined between any adjacent two of the at least three lower connection positions.

4. The folding chair support frame according to claim 3, wherein the interval is capable of or substantially capable of accommodating at least one of the upper connection rods.

5. The folding chair support frame according to claim 3, wherein the upper connection rods rotate around first connection shafts with respect to the upper connection component, and a vertical distance from a center of each of the first connection shafts to an axis of the upper connection component is greater than or equal to a vertical distance from a lowest point of the interval to the axis.

6. The folding chair support frame according to claim 3, wherein a maximum rotation angle of each of the upper connection rods is greater than 90 degrees.

7. The folding chair support frame according to claim 3, wherein the upper connection rods are telescopic rods.

8. The folding chair support frame according to claim 3, wherein when the folding chair support frame is in an unfolded state, the upper connection rods and the lower connection rods are respectively located on an upper side of the connection body and a lower side of the connection body, and the upper connection rods and the lower connection rods face opposite directions; and when the folding chair support frame is in the folded state, the free ends of the upper connection rods and the free ends of the lower connection rods are located below the connection body.

9. A folding chair support frame, comprising:

a connection body; and connection components;

wherein the connection components are connected to the connection body; the connection body comprises upper connection positions and lower connection positions; the connection components comprise upper connection rods and lower connection rods; the upper connection positions are connected to the upper connection rods, and the lower connection positions are connected to the lower connection rods; an interval capable of accommodating at least one of the upper connection rods is defined between any adjacent two of the at least three lower connection positions; and the upper connection rods and the lower connection rods are located on a same side of the connection body in a folded state;

wherein the lower connection rods are rotatably connected to the lower connection component at the limited angle by rotatable connection components;

wherein the upper connection component is fixedly connected to an upper end of a central shaft, the central shaft passes through the lower connection component, a sleeve is sleeved outside the central shaft, and the sleeve is movable along an axial direction of the central shaft;

wherein grooves are defined on the sleeve, and convex teeth matching with the grooves are disposed on a head of the rotatable connection component.

10. The folding chair support frame according to claim 9, wherein when the folding chair support frame is in an unfolded state, the upper connection rods and the lower connection rods are respectively located on an upper side of the connection body and a lower side of the connection body, and the upper connection rods and the lower connection rods face opposite directions.

11. The folding chair support frame according to claim 10, wherein the upper connection positions and the lower connection positions are evenly distributed in a staggered manner along a circumferential direction of the connection body, and the connection components are detachably connected to the connection body.

12. The folding chair support frame according to claim 9, wherein the interval is configured to accommodate the upper connection rods;

when the folding chair support frame is in the folded state, the upper connection rods and the lower connection rods located on the same side of the connection body are spaced apart from each other; and a maximum radial cross-sectional area of the connection body is greater than or equal to a cross-sectional area of a minimum size of the folding chair support frame in the folded state.

13. A folding chair support frame, comprising:

a connection body; and connection components;

wherein the connection components are connected to the connection body; the connection body comprises upper connection positions and lower connection positions; the connection components comprise upper connection rods and lower connection rods; the upper connection positions are connected to the upper connection rods, and the lower connection positions are connected to the lower connection rods; when the folding chair support frame is in an unfolded state, the upper connection rods and the lower connection rods face opposite directions, and are located on an upper side of the connection body and a lower side of the connection body; and when the folding chair support frame is in a folded state, free ends of the upper connection rods and free ends of the lower connection rods are located below the connection body;

wherein the lower connection rods are rotatably connected to the lower connection component at the limited angle by rotatable connection components;

wherein the upper connection component is fixedly connected to an upper end of a central shaft, the central shaft passes through the lower connection component, a sleeve is sleeved outside the central shaft, and the sleeve is movable along an axial direction of the central shaft;

wherein grooves are defined on the sleeve, and convex teeth matching with the grooves are disposed on a head of the rotatable connection component.

14. The folding chair support frame according to claim 13, wherein when the folding chair support frame is in the unfolded state, the upper connection rods and the lower connection rods are respectively located on the upper side of the connection body and the lower side of the connection body, and the upper connection rods and the lower connection rods face opposite directions.

15. The folding chair support frame according to claim 13, wherein the upper connection positions and the lower connection positions are evenly distributed in a staggered manner along a circumferential direction of the connection body, and the connection components are detachably connected to the connection body.

16. The folding chair support frame according to claim 13, wherein the interval is configured to accommodate the upper connection rods;

when the folding chair support frame is in the folded state, the upper connection rods and the lower connection rods located on a same side of the connection body are spaced apart from each other; and a maximum radial cross-sectional area of the connection body is greater than or equal to a cross-sectional area of a minimum size of the folding chair support frame in the folded state.

17. The folding chair support frame according to claim 13, wherein an angle formed when the upper connection rods are rotated from the folded state to the unfolded state is greater than 90 degrees.

* * * * *